United States Patent [19]

Hughes

[11] Patent Number: 4,526,564

[45] Date of Patent: Jul. 2, 1985

[54] FLAP SEPARATOR FOR A CARTONING MACHINE

[75] Inventor: Charles C. Hughes, Villa Hills, Ky.

[73] Assignee: R. A. Jones & Co. Inc., Covington, Ky.

[21] Appl. No.: 508,345

[22] Filed: Jun. 24, 1983

[51] Int. Cl.[3] ..... B31B 1/76; B65B 43/00

[52] U.S. Cl. ..... 493/183; 493/314; 493/453; 53/252; 53/382; 53/566

[58] Field of Search ..... 53/252, 381 R, 382, 53/387, 564, 566; 493/32, 178, 179, 181, 183, 438, 453, 309, 313, 314

[56] References Cited

U.S. PATENT DOCUMENTS 2,750,856 6/1956 Ferguson et al. ..... 493/183
4,089,150 5/1978 Heisler ..... 53/252

*Primary Examiner*—Robert L. Spruill
*Assistant Examiner*—Richard M. Mudd
*Attorney, Agent, or Firm*—Wood, Herron & Evans

[57] ABSTRACT

In a cartoning machine, a conveyor conveys flat folded cartons with their end flaps projecting laterally. A rotating disk having a horizontally-projecting pin engages the flaps in timed relation to their longitudinal movement to press a lower major flap downwardly. When in a downward attitude, the major flap is engaged by a plow or hold-down guide which holds the flap during erection of the carton and loading of the carton.

4 Claims, 10 Drawing Figures

FLAP SEPARATOR FOR A CARTONING MACHINE

This invention relates to a constant motion cartoner, and more particularly, this invention relates to an improved flap separator for the cartoner.

In a cartoning machine generally, cartons in a flat folded condition are erected and captured between leading and trailing lugs of a transport conveyor and carried past a barrel loader. A product bucket conveyor running alongside the transport conveyor has a series of product buckets, each of which contains product to be loaded into the cartons. The flaps of the carton are held open as the cartons pass the barrel loader and there the product is thrust into the open carton. Thereafter, the flaps are closed and sealed.

The carton usually has leading and trailing dust flaps and upper and lower major flaps. When such a carton is fed into the cartoner in flat folded condition, it is important to separate the lower major flap from the remaining flaps and bend it downwardly so that it can be captured by a plow or hold-down guide. In one embodiment of the invention, the carton is immediately erected after the major flap is captured by the plow, the erecting being performed by delivering a blast of air into the ends of the tubular carton.

One prior mechanism for separating the flaps has been a horizontal rail cooperating with overhead fingers which pushed the flaps down below the rail. The rail had a gap in it permitting the leading dust flap to pop up as the carton was conveyed past the gap. The larger major flap could not pop up through the gap and would therefore be selectively held down. This approach was not always too reliable, particularly if the cartons did not have the necessary resilience or "fight" which would cause the dust flap to snap up to its original position.

An objective of the present invention has been to provide a more positive and, hence, more reliable mechanism for separating the lower major flap from the flaps overlying it so that it can be captured by the plow or hold-down guide.

This objective of the invention is attained by providing a disk which is rotated on a horizontal axis adjacent a conveyor for the flat folded cartons. A pin projects horizontally from the face of the disk and is engageable with the flaps of the carton to selectively engage and temporarily hold down the lower major flap until it is captured by a plow immediately downstream of the rotating disk.

The cartons are presented to the flap separator in two orientations. In the first orientation, the upper dust flap is leading and overlies the lower major flap. In the other orientation, the upper dust flap is trailing and overlies the lower major flap.

The mechanism of the present invention is suitable for separating flaps of either orientation with only a slight change of timing required. Where the upper dust flap is leading, the disk is timed with relation to the carton conveyor to engage the upper surface of the leading dust flap to press it and the lower major flap down. As the conveyor conveys the carton past the disk, the pin rides past the upper dust flap and selectively holds only the lower major flap down until it is engaged by the plow immediately downstream of the disk.

Where the upper dust flap trails, the lower dust flap leads. In that orientation, with a slight alteration of the timing of the disk, the pin will engage the lower surface of the leading dust flap and push it upwardly until the pin rides over the upper surface of the lower major flap. As the pin then starts to descend, it will be free of the dust flap and will engage only the lower major flap to force it downwardly so that it can engage the plow.

Another feature of the invention has been to provide a plow or hold-down guide which has an upstream tip engageable with the downwardly-depressed dust flap. At its downstream end, the plow is pivoted so that it can swing horizontally through an arc of about 15°, thereby enabling it to accommodate various widths or configurations of flaps.

The several features of the invention will become more readily apparent from the following detailed description taken in conjunction with the accompanying drawings in which.

Figure 1:
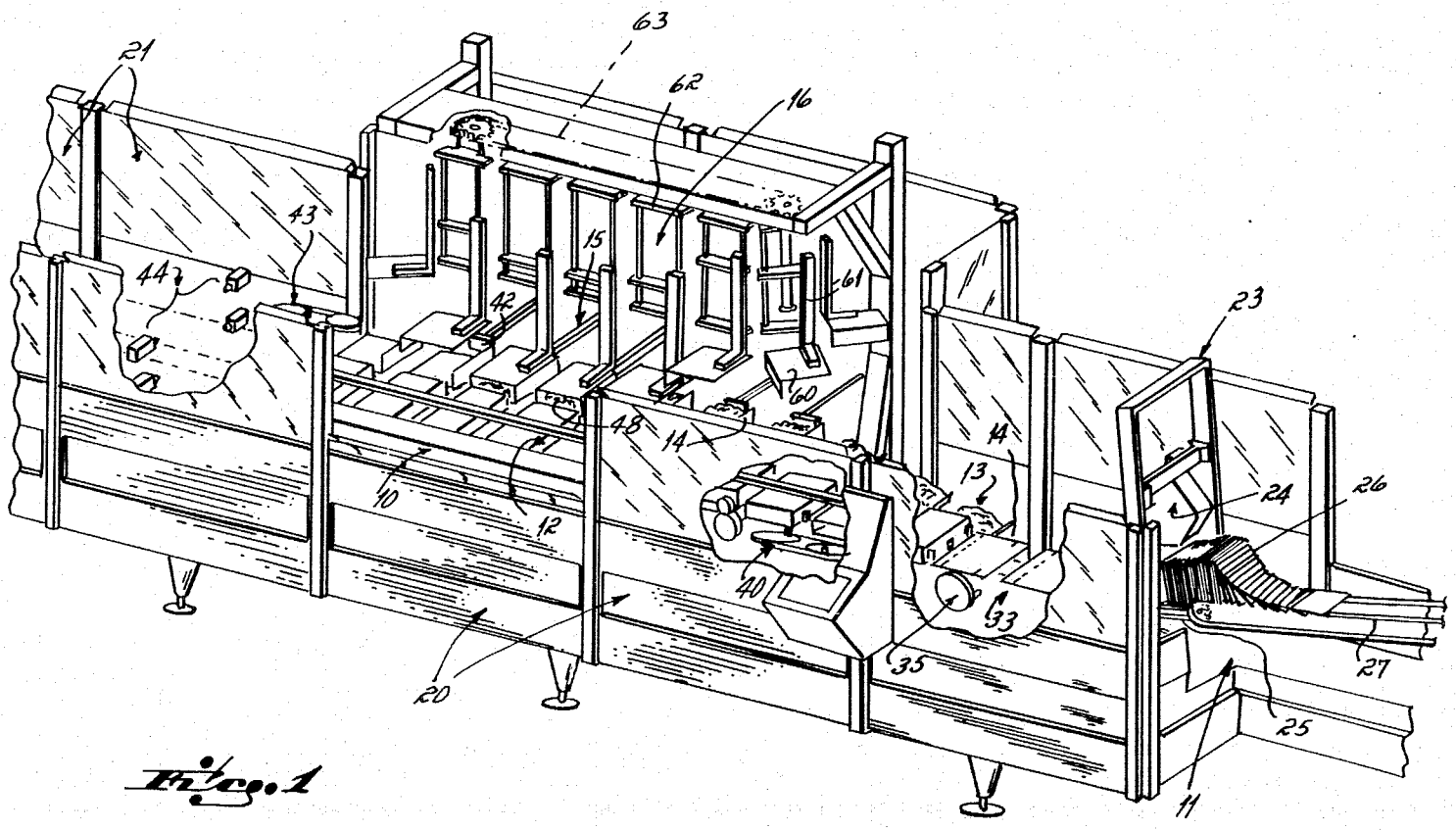
FIG. 1 is a diagrammatic perspective view of a cartoner of the present invention.

FIGS. *6a, b* and *c* are fragmentary perspective views illustrating a sequence of pin positions in the separating of the flaps of one type of carton orientation; and FIGS. *7a* and *b* are fragmentary perspective views showing a sequence of positions of the pin separating the flaps of another type of carton orientation.

GENERAL ORGANIZATION AND OPERATION

A cartoner with which the present invention is employed includes a frame 10 which supports the principal operating elements. The frame supports a carton feeder 11, a carton transport conveyor 12, a product bucket conveyor 13 and product buckets 14 mounted on the conveyor and a barrel loader 15. In this instance, an overhead tamper confiner 16 is employed for products which must be compressed either vertically or horizontally or both in order to size them for introduction into the carton.

The cartoner is surrounded by a series of lower opaque guard panels 20 and guard windows 21 which are capable of being raised and lowered to expose the operating components of the machine for repairs, unclogging jams and the like.

In somewhat more detail, the feeder 11 has a frame 23 which supports a rotatable feed mechanism 24 of the type disclosed in the copending application of Scarpa et al Ser. No. 276,081, filed June 22, 1981 now U.S. Pat. No. 4,429,864. The feeder also includes a pair of spaced parallel downstream chains 25 on which flat folded cartons 26 are supported and gradually moved toward the rotary feeding device. The cartons 26 may be placed on upstream notched chains 27 by an operator, they may be fed onto the chains one at a time by a vertically oriented magazine, or they may be fed onto the chains 25 by an overhead conveyor which receives the cartons from a side seam gluer, not shown. The chains will be described in more detail below.

The carton transport conveyor 12 has three elongated, parallel endless chains 29. The outboard chains support trailing transport lugs 30. The center chain 31 supports a leading transport lug 32. The center chain may be shifted with respect to the outboard chains in order to vary the spacing between the leading and trailing transport lugs in order to accommodate cartons of differing lengths (the length of the carton is the dimension in the machine direction). The cartons are fed in the flat folded condition onto the transport conveyor. Prior to being captured between the leading and trailing transport lugs of the conveyor 12, the carton is transported from the feeder by a conveyor 33. During the traverse of conveyor 33, the carton flaps are separated by a flap separator 35 which forces a lower flap downwardly into a position where it can be engaged by a stationary plough which holds the carton against vertical movement during opening. The carton then moves through an air opener 36 which directs blasts of air from either side of the carton in a horizontal direction to force air between the upper and lower walls of the carton, thereby causing the carton to swing to an erect orientation between the leading and trailing lugs of the transport conveyor. That air opener is disclosed in U.S. Pat. No. 3,728,945, issued Apr. 24, 1973.

Immediately downstream of the air opener are opposed flap spreaders 40 on the bucket side and flap closers on the opposite or operator's side of the cartoner. The flap spreaders carry lugs 41 which engage the leading flap of the carton and swing it through 90° so that it can be captured by stationary rails and held in that attitude as the carton passes the barrel loader 15. The trailing flap is similarly captured by the rails and held open.

As the carton passes the barrel loader, pusher heads 42 engage products in the product buckets and thrust them across the product buckets into the opened cartons.

After the carton has been filled, it is conveyed past flap closer 43 which engages the trailing flaps and swings them to a closed position. Glue guns 44 are mounted alongside the carton conveyor downstream of the flap closer (on the bucket side) 43. The glue guns apply an appropriate pattern of glue to one of the vertical major flaps of the carton. When the glue is applied, ploughs swing the vertical flaps to a closed position and hold them there during the brief period required for the glue to set.

Figure 3:
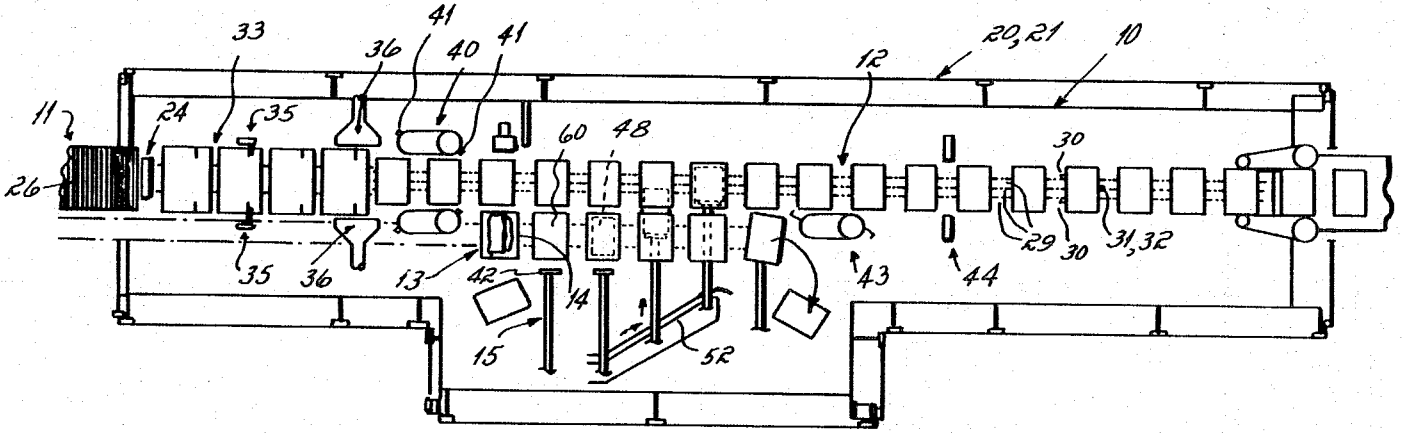
FIG. 3 is a diagrammatic top plan view of the invention.
Figure 2:
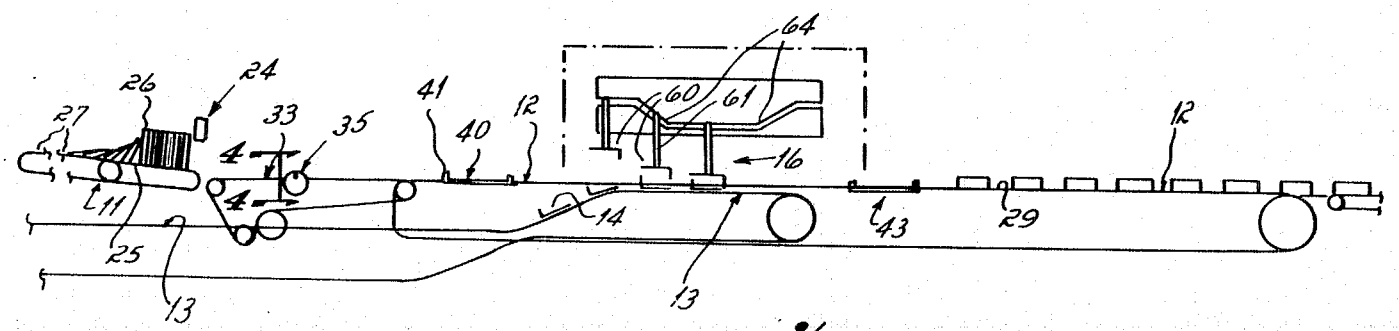
FIG. 2 is a diagrammatic side elevational view.

The product bucket conveyor 13 consists of a pair of endless chains which support a series of spaced product buckets 14 which convey products 48 past the open cartons. The product buckets may be L-shaped as shown, or may be U-shaped depending upon the product to be filled into the carton and the need for imparting shaping to the product to enable it to conform dimensionally to the size of the carton. The barrel loader 15 diagrammatically illustrated in FIG. 3 consists of a series of pusher heads 42 which are slidably supported on endless chains. The pusher heads have cam followers which ride in a cam track 52. As the pusher heads are conveyed on the upper run of the chains which support them, the cam track 52 causes each pusher head to move across the product bucket where it engages the product 48 and thrusts it into an open carton.

In the illustrated form of the invention, the tamper confiner 16 has a series of L-shaped tamper confiner elements 60 which are carried by vertical posts 61 and supported on carriages 62. The carriages are connected to endless chains 63 mounted on horizontal sprockets, not shown, to convey the tamper confiner elements over the upper run of the product bucket conveyor adjacent the barrel loader. A cam track 64 is mounted adjacent the path of the posts 61. The posts 61 have the followers which ride in the cam track to lower the tamper confiners as they pass over the product buckets and to raise them after the carton has been filled with product by the barrel loader so that they can be swung out of the way of the mechanism during their excursion around to the outside of the cartoner. The L-shaped tamper confiner elements cooperate with the L-shaped product buckets to engage the product such as a breakfast cereal pouch and to shape it into a generally rectangular cross section matching that of the interior of the carton, thereby enabling the pusher heads 42 to thrust the pouch into the cartons. If the product buckets are U-shaped, the tamper confiner may be a flat platen which simply compresses the product as, for example, facial tissues, so that vertical dimension of the product matches the dimension of the carton opening.

In the operation of the cartoner the flat folded carton blanks are fed from the feeder 24 toward the transport conveyor. The upper and lower flaps of the carton are separated so as to permit air to be introduced between the upper and lower walls of the carton. At the air opener 36, blasts of air erect the carton between the leading and trailing transport lugs. As the cartons move downstream, the horizontal flaps are plowed up and down and the vertical flaps are swung through 90° on both sides of the carton to prepare the carton for the introduction of product.

Product which has been transferred to the product buckets is confined by the overhead tamper confiner 16 as the products pass the barrel loader 15. There, the pusher heads 42 of the barrel loader drive each product across the product bucket and into the carton opposite it as the product buckets and transport conveyors move alongside each other past the barrel loader.

After the product has been loaded into the cartons, the carton flaps have a pattern of glue applied to them and are closed and held in a closed condition until the glue sets.

The Flap Separator

As indicated above, the flap separator 35 is located immediately upstream of the air opener 36. At this stage, prior to erecting the carton, the cartons are carried on endless chains 70 having spaced upwardly-projecting lugs 71 which engage the trailing edge of the flat folded carton 26. Collectively, the chains and lugs constitute the conveyor 33 referred to above.

Figure 4:
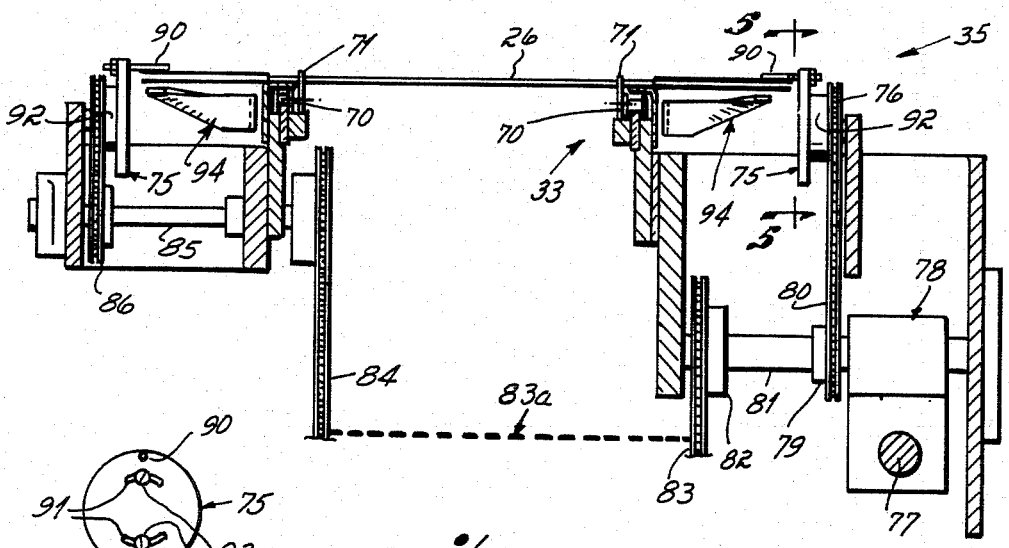
FIG. 4 is a cross-sectional view taken along lines 4—4 of FIG. 2 illustrating the separator.
Figure 5:
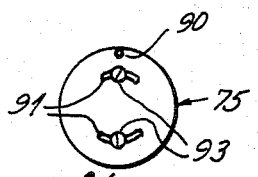
FIG. 5 is a cross-sectional view taken along lines 5—5 of FIG. 4.
Figure 6A:
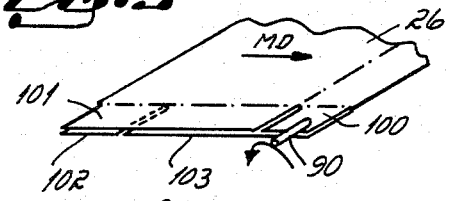
Figure 6B:
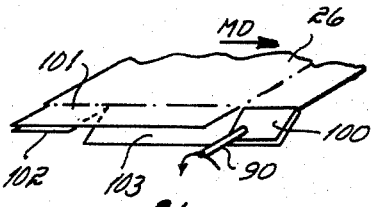
Figure 6C:
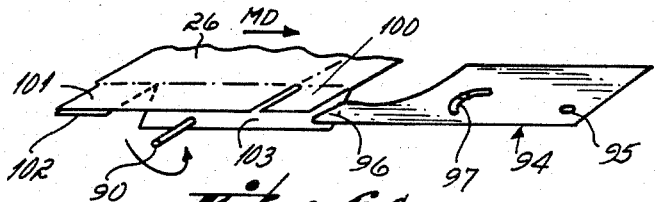
Figure 7A:
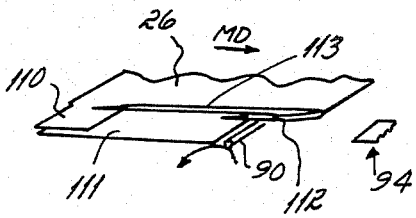
Figure 7B:
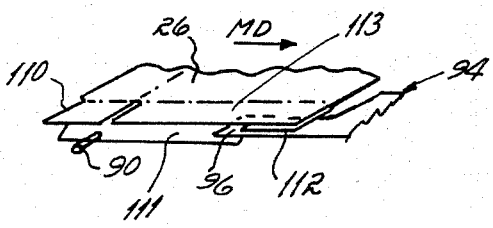

A disk 75 is rotatably mounted on each side of the conveyor 33. Each disk has a sprocket 76 by which it is driven. As viewed in FIG. 4, the right-hand disk is driven from an accessory drive shaft 77, which is connected to the main cartoner drive. The drive shaft 77 is connected through a gear box 78 to a sprocket 79. A chain 80 passes over the sprockets 79 and 76 to drive the disk 75.

A shaft 81 is connected to the sprocket 79 and a sprocket 82 is mounted on the shaft 81. A chain 83 passes over the sprocket 82 and is connected to a sprocket and shaft assembly, represented by dotted line **83*a*, which drives a chain 84 which in turn drives a shaft 85 and a sprocket and chain combination 86 connected to the left-hand disk 75**.

Each disk carries a horizontal pin 90 which overlies the flaps of the carton 26 as the cartons are conveyed by the conveyor 33 past the disks. The length of the pin can be changed either by screwing it in or out with respect to the disk or by substituting a pin of different length. This enables the pin to accommodate differing flap lengths. The angular position of each pin also can be altered so that the movement of the pin can be properly timed to the movement of the carton by the conveyor 33, thus enabling the flap separator to accommodate varying sizes and styles of cartons. The disk 75 has two arcuate slots 91 by which the disk is mounted to a hub 92 secured to the sprocket 76. A pair of set screws 93 are mounted on the hub 92. The screws pass through the arcuate slots and have heads engageable with the surface of the disk 75 so that when the screws are loosened, the angular position of the disk can be changed and when the screws are tightened, the angular position of the disk will remain fixed.

Immediately downstream of each disk 75 is a plow or hold-down guide 94 which is pivoted at 95 to the cartoner frame. Upstream of the pivot 95 is a tip 96 which engages the lower major flap of the carton. The plow has an arcuate slot 97 and a set screw which permit the plow to be swung about its pivot axis 95 through an arc of about 15° to adjust its position, thereby enabling it to accommodate differing widths and styles of lower major flaps.

The operation of the invention for one form of carton is illustrated in FIGS. *6a–c*. In that form of the carton, the carton has a upper dust flap 100 in a leading position. Connected serially are an upper major flap 101, a trailing lower dust flap 102 and a lower major flap 103. As the carton is conveyed in the machine direction, indicated by the arrow MD, past the disks 75, each pin 90 carried by a respective disk goes through the sequence of positions illustrated in FIGS *6a–c* to separate the flaps. First, the pin engages the leading upper dust flap. As the disk continues to rotate, carrying the pin in a downward, upstream path, the pin forces the dust flap 100 and the lower major flap underneath it in a downward attitude. As the carton continues to move past the disk, that motion, coupled with the rearward component of motion of the pin 90, causes the pin to ride over the dust flap 100 so that it engages only the lower major flap 103 to hold it down. In this attitude, the flap then rides under the plow 94 whereby it will be held down by rails extending downstream of the plow 94 through the loading of the carton.

The flap separator is equally useful in separating flaps of a carton wherein the dust flaps are oppositely oriented. As shown in FIGS. *6a* and *6b*, the upper dust flap 110 is trailing. Serially, the remaining flaps are the lower major flap 111, the lower leading dust flap 112 and the upper major flap 113. By shifting the timing of the pin 90 with respect to the conveyor 33, the pin will engage the carton slightly differently to accommodate the different orientations of the carton. First, the pin will engage the underside of the leading dust flap 112, as shown in FIG. *6a*. As the elements continue to move with respect to each other, the pin will ride past that dust flap and engage the upper surface of the lower major flap 111. In continuing to move the pin, it pushes the major flap downwardly so that it rides under the plow 94. It should be observed that in this organization, the leading edge of the lower major flap is engaged which provides better control, particularly for long, flimsy flaps than engaging the trailing end of the flap as had been done with previous flap separators.

Having now described my invention, I claim:

1. In a cartoning machine, a flap separator comprising, a conveyor for continuously conveying flat folded cartons with the end flaps projecting laterally from the carton, said end flaps including upper and lower major flaps and upper and lower dust flaps between said upper and lower major flaps, a support rotatably mounted adjacent said conveyor, a pin mounted on said support and projecting toward said conveyor for engagement with said flaps, means for timing said rotatable support to said conveyor to cause said pin to engage said flaps and bend a lower major flap downwardly, a plow downstream of said support to capture only said lower major flap and hold it down and means for erecting said carton while said lower major flap is held under said plow.

2. A cartoning machine as in claim 1 in which each carton has serially a leading upper dust flap, an upper major flap, a trailing lower dust flap and a lower major flap, said pin initially engaging the top of said upper dust flap and forcing it and the underlying lower major flap downwardly, said pin sliding off said dust flap as said conveyor moves said carton past said support, said pin thereafter forcing only said lower major flap downwardly for engagement with said plow.

3. a cartoning machine as in claim 1 in which each carton has serially, a leading lower dust flap, a lower major flap, a trailing upper dust flap and an upper major flap, said pin initially engaging the under surface of said leading lower dust flap to swing it up above the plane of said carton, said pin thereafter passing over said lower major flap and forcing it downwardly for engagement with said plow.

4. A cartoning machine as in claim 1 in which said plow comprises a horizontal plate having a tip projecting upstream, said plate being pivoted on a vertical axis downstream of said tip whereby the position of said tip can be shifted toward or away from said carton conveyor to accommodate different styles of flaps.

* * * * *